US005613880A

United States Patent [19]

Wang

[11] Patent Number: 5,613,880

[45] Date of Patent: Mar. 25, 1997

[54] DUAL-PLUG BNC CONNECTOR

[76] Inventor: Tsan-Chi Wang, 1F., No. 13, Lane 312, Chung Chen Rd., Hsin Tien City, Taipei Hsien, Taiwan

[21] Appl. No.: 506,960

[22] Filed: Jul. 28, 1995

[51] Int. Cl.[6] ..... H01R 13/66

[52] U.S. Cl. ..... 439/620; 439/541.5

[58] Field of Search ..... 439/620, 540.1, 439/541.5; 333/181–185

[56] References Cited

U.S. PATENT DOCUMENTS

| | | | |
|---|---|---|---|
| 4,659,156 | 4/1987 | Johnescu et al. | 439/378 |
| 4,797,120 | 1/1989 | Ulery | 439/620 |
| 5,078,623 | 1/1992 | Wang | 439/620 |
| 5,108,300 | 4/1992 | Weber | 439/620 |
| 5,145,412 | 9/1992 | Tan et al. | 439/620 |
| 5,167,536 | 12/1992 | Wang | 439/620 |
| 5,326,280 | 7/1994 | Briones et al. | 439/620 |
| 5,340,325 | 8/1994 | Pai | 439/620 |
| 5,387,116 | 2/1995 | Wang | 439/620 |
| 5,393,252 | 3/1995 | Wang | 439/620 |
| 5,401,192 | 3/1995 | Briones et al. | 439/620 |
| 5,407,366 | 4/1995 | Briones et al. | 439/620 |
| 5,417,585 | 5/1995 | Morin et al. | 439/541.5 |

*Primary Examiner*—Gary F. Paumen
*Attorney, Agent, or Firm*—Lowe, Price, LeBlanc & Becker

[57] ABSTRACT

A dual-plug BNC connector including two BNC plugs, an insulative casing, filter means respectively mounted in the insulative casing to filter noises from the BNC plugs, and mounting rod means fixedly secured to the insulative casing for fastening it to a circuit board, wherein BNC plugs are mounted in parallel in the insulative casing and respectively connected to the circuit board.

1 Claim, 4 Drawing Sheets

DUAL-PLUG BNC CONNECTOR

BACKGROUND OF THE INVENTION

The present invention relates to BNC (bayonet navy connector) connectors, and relates more particularly to a dual-plug BNC connector which has two BNC plugs.

A variety of connectors for installation in a PC board to connect a coaxial cable have been developed. Exemplars are seen in U.S. Pat. Nos. 5,397,252; 4,797,120; 5,413,520; 4,659,156; 4,074,809, etc. The disclosures of U.S. Pat. Nos. 5,397,252; 4,797,120; and 5,413,520 teach the installation of capacitive filter means to eliminate the interference of outside noises However these disclosures and the others of the aforesaid U.S. patents commonly have only one BNC plug for the connection of a BNC jack. When two connect two BNC jacks from a network cable to a PC board, two BNC connectors must be used. However, much PC board installation space is needed when the number of BNC connectors is increased. There is developed an electrical connector which combines two BNC connectors together by securing two BNC connectors to a thin metal sheet, permitting the shells of the BNC connectors to be connected in parallel to earth. This combined structure of electrical connector needs less PC board installation space, however it is not applicable for mounting with filter means to eliminate the interference of outside noises.

SUMMARY OF THE INVENTION

The present invention has been accomplished to provide a dual-plug BNC connector which eliminates the aforesaid drawbacks.

According to one aspect of the present invention, the dual-plug BNC connector comprises one insulative casing and two BNC plugs mounted in the insulative casing in parallel and respectively connected to the circuit board when the insulative casing is installed. Because two BNC plugs are combined together, less circuit board installation space is needed when two BNC jacks are connected. According to another aspect of the present invention, the two BNC plugs have a respective independent filter means, a respective independent signal terminal, and a respective independent earth terminal, therefore different earth connecting conditions of the BNC plugs do not affect the normal operation of the electrical connector.

DETAILED DESCRIPTION OF THE PREFERRED EMBODIMENT

Figure 2:
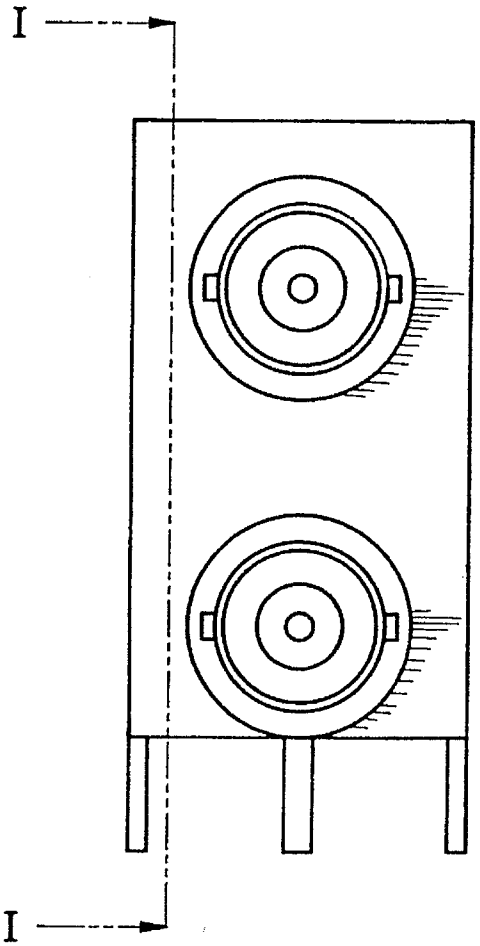
Fig. 2 PRIOR ART
FIG. 2 is a cross sectional view of the electrical connector shown in FIG. 1.
Figure 1:
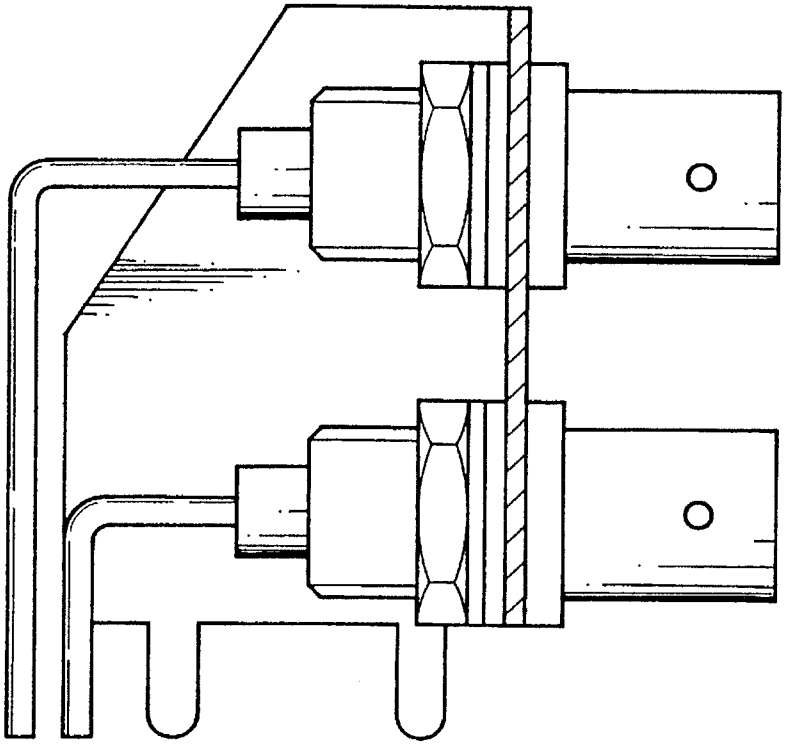
Fig. 1 PRIOR ART
FIG. 1 is a front view of an electrical connector with two BNC connectors combined together according to the prior art.
Figure 3:
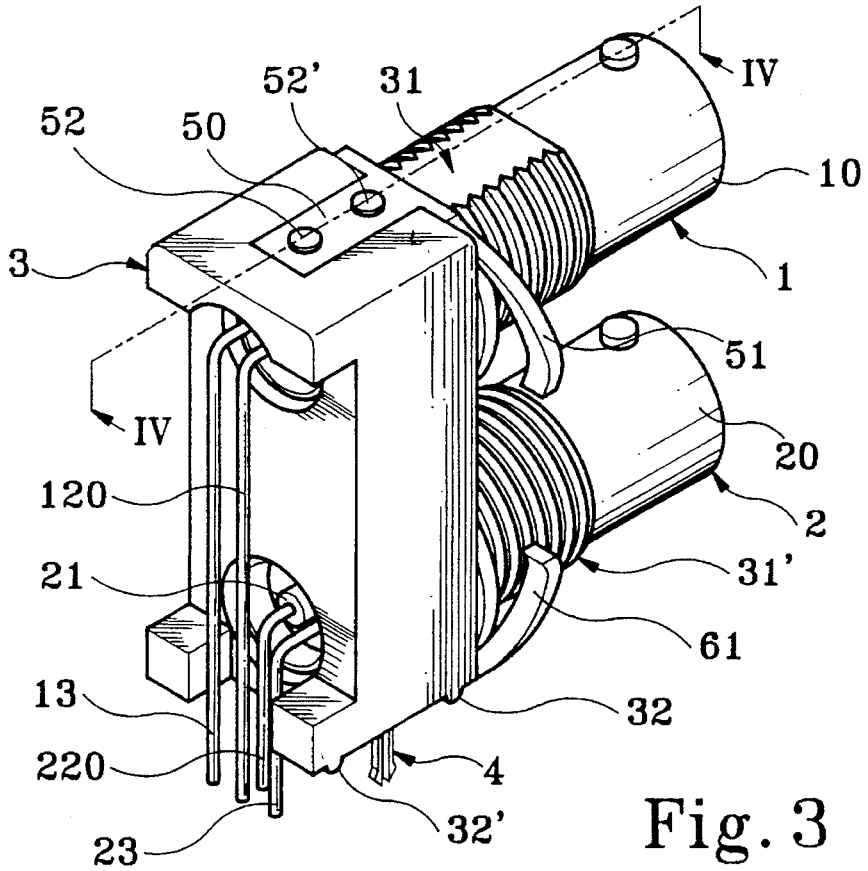
FIG. 3 is an elevational view of a dual-plug BNC connector according to the present invention.
Figure 4:
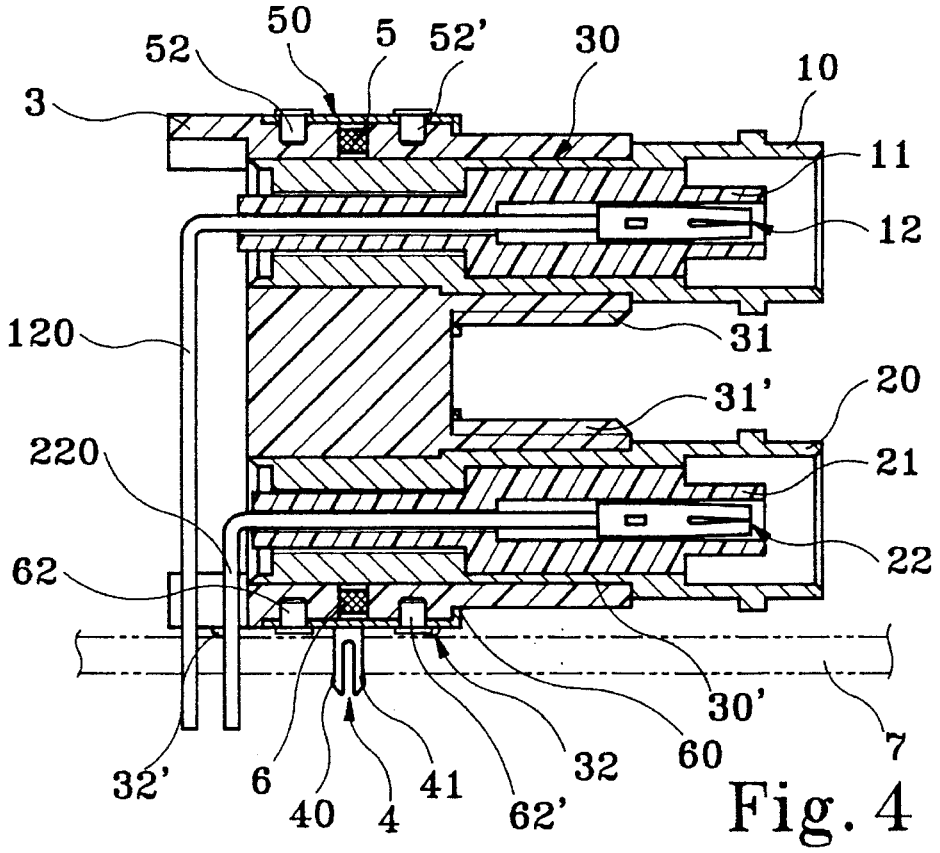
FIG. 4 is a sectional view taken along line IV—IV of FIG. 3.

Referring to FIGS. 3 and 4, a BNC connector in accordance with the present invention is generally comprised of a first BNC plug 1, a second BNC plug 2, a casing 3, which holds the first BNC plug 1 and the second BNC plug 2 in parallel, two filter means respectively mounted in the casing 3 to filter noises, and a plurality of split mounting rods 4 for fastening the casing 3 to a circuit board 7.

Referring to FIG. 4 again, the casing 3 is injection-molded from insulative material (plastics) having two parallel axial holes 30 and 30' for mounting the first BNC plug 1 and the second BNC plug 2 and two externally threaded coupling portions 31 and 31' respectively axially extended from the axial holes 30 and 30' at one side for mounting on an object. The BNC connectors 1 and 2 are identical and respectively fastened to the casing 3, each comprising a tubular metal shell 10 or 20, an insulative tube 11 or 21 axially mounted within the tubular metal shell 10 or 20, a signal terminal 12 or 22 axially mounted inside the insulative tube 11 or 21 and having a tail 120 or 220 connected to the circuit board 7, and an earth terminal 13 or 23 extended from the tubular metal shell 10 or 20 for connection to earth to form with the tubular metal shell 10 or 20 an earth loop. The aforesaid filter means each comprises a capacitor 5 or 6 mounted in a respective through hole (not shown) on the casing 3, and a conductive plate 50 or 60 fastened to the casing 3 at one side by fastening elements 52 and 52', or 62 and 62' to hold down the capacitor 5 or 6, permitting both terminals of the capacitor 5 or 6 to be respectively connected between the tubular metal shell 10 or 20 of the BNC plug 1 or 2 and the conductive plate 50 or 60. The aforesaid split mounting rods 4 are fixedly secured to the bottom side of the casing 3, each split mounting rod 4 comprised of two hooked portions 40 and 41. The casing 3 further comprises a plurality of raised portions 32 and 32' raised from the bottom side. When the casing 3 is installed in the circuit board 7, the raised portions 32 and 32' are stopped above the circuit board 7 to space the conductive plate 60 from the circuit board 7, and therefore the conductive plate 60 does not contact the circuit board 7.

Figure 5:
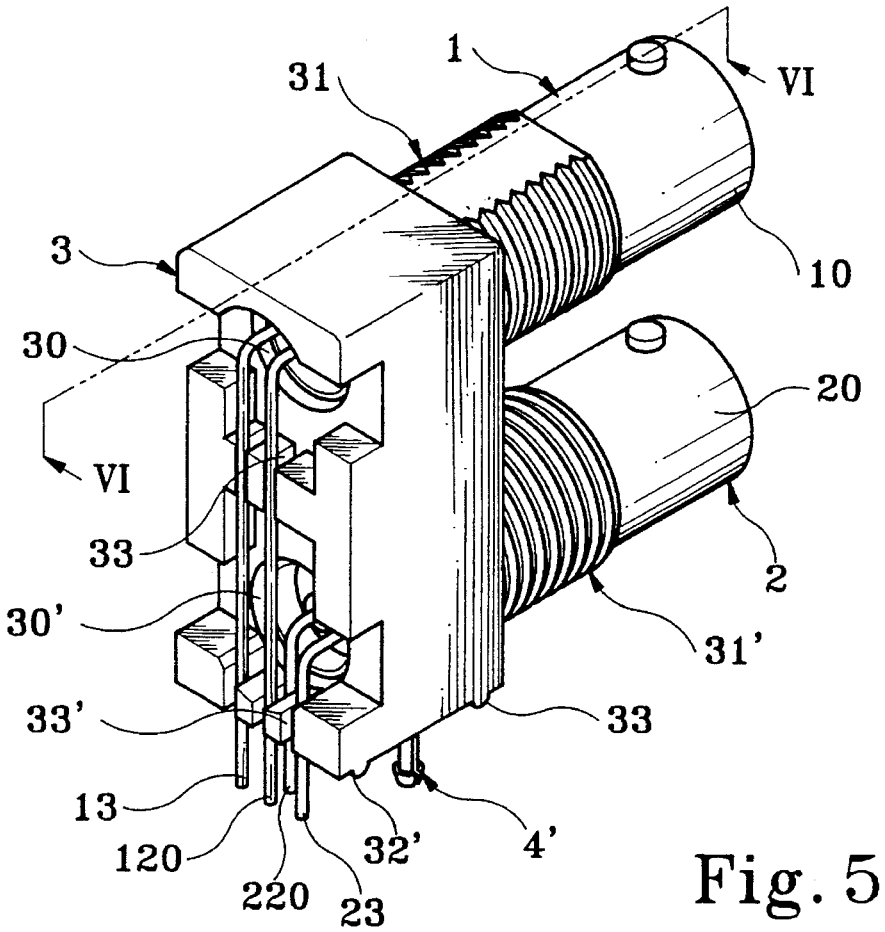
FIG. 5 is an elevational view of an alternate form of the dual-plug BNC connector according to the present invention.
Figure 6:
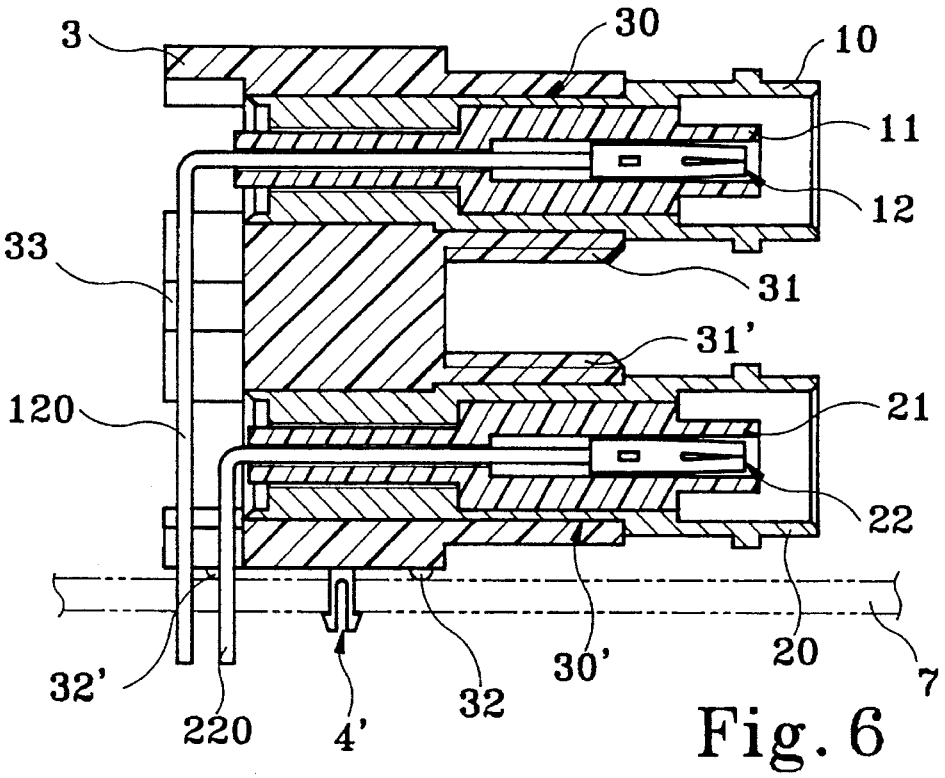
FIG. 6 is a sectional view taken along line VI—VI of FIG. 5.

FIGS. 5 and 6 show an alternate form of the present invention. This alternate form eliminates the installation of the aforesaid filter means, however mounting grooves 33 and 33' are made on the casing 3 to hold the earth terminals 13 and 23 and the tails 120 and 220 of the signal terminals 12 and 22.

Figure 7:
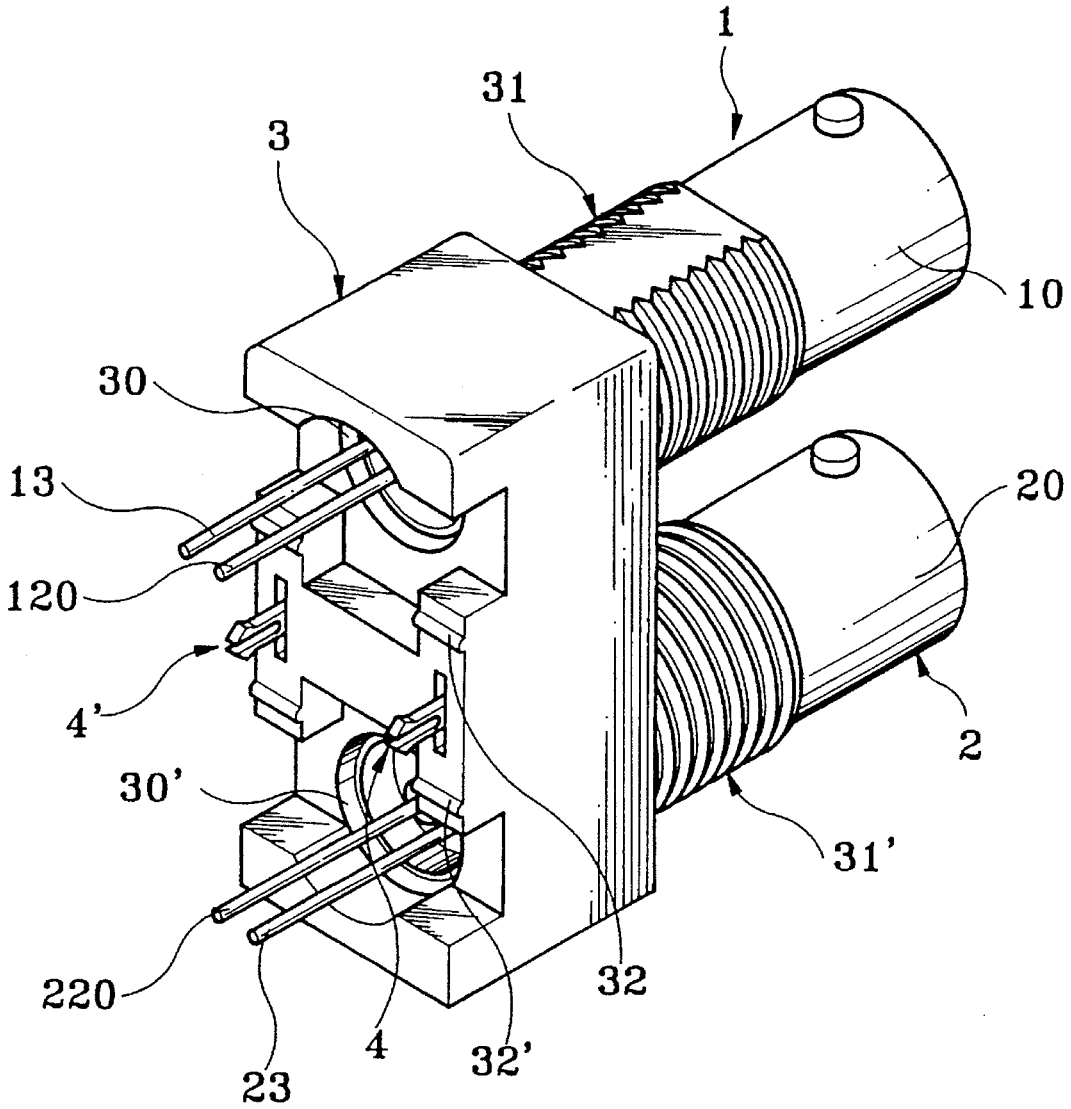
FIG. 7 is an elevational view of another alternate form of the dual-plug BNC connector according to the present invention.

FIG. 7 shows another alternate form of the present invention. According to this alternate form, the tails 120 and 220 of the signal terminals 12 and 22 and the earth terminals 13 and 23 are made of straight shape and respectively axially extended from the BNC plugs 1 and 2; the split mounting rods 4 and 4' and the raised portions 32 and 32' are respectively raised from the back side of the casing 3 in the same direction of the signal terminals 12 and 22 and the earth terminals 13 and 23. This arrangement permits the electrical connector to be installed in a circuit board in vertical.

It is to be understood that the drawings are designed for purposes of illustration only, and are not intended as a definition of the limits and scope of the invention disclosed.

I claim:

1. A dual-plug BNC connector comprising two BNC plugs, an insulative casing, filter means respectively mounted in said insulative casing to filter noises from said BNC plugs, and mounting rod means fixedly secured to said insulative casing for fastening it to a circuit board, wherein said BNC plugs are mounted in parallel in said insulative casing and respectively connected to said circuit board.

* * * * *